United States Patent [19]

Mosier

[11] Patent Number: 4,733,680

[45] Date of Patent: Mar. 29, 1988

[54] DISPENSER APPARATUS

[76] Inventor: Larry G. Mosier, 10007 Cedardale, Houston, Tex. 77055

[21] Appl. No.: 864,475

[22] Filed: May 19, 1986

[51] Int. Cl.[4] ..... B65B 3/06

[52] U.S. Cl. ..... 141/31; 141/234; 141/367; 222/483

[58] Field of Search ..... 141/234–248, 141/367, 368, 31; 222/481, 481.5, 483

[56] References Cited

U.S. PATENT DOCUMENTS

| | | | |
|---|---|---|---|
| 212,494 | 2/1879 | Paddock | 141/238 |
| 1,416,126 | 5/1922 | Rainey | 141/244 |
| 1,488,603 | 4/1924 | Kouwenhoven | 141/238 |
| 2,155,336 | 4/1939 | Smith | 141/367 |
| 2,872,953 | 2/1959 | Duncan | 141/237 |
| 3,196,909 | 7/1965 | Monk | 141/237 |
| 4,658,870 | 4/1987 | Powell et al. | 141/238 |

*Primary Examiner*—Houston S. Bell, Jr.
*Attorney, Agent, or Firm*—Hubbard, Thurman, Turner & Tucker

[57] ABSTRACT

A dispenser for manually filling a plurality of liquid receptacles simultaneously is disclosed. The dispenser includes an elevated base having a plurality of apertures through which liquid may flow into receptacles or cups positioned thereunder. Leg members support the base to position the apparatus over the receptacles. A filler tank is secured to the base for retaining a volume of liquid. Sandwiched between the filler tank and the base, a slide cover is manually rotatable over the base between an open position and a closed position so that a plurality of selectively placed apertures in the slide cover line up with selected apertures in the base to permit fluid flow therethrough. The filler tank of the apparatus includes a vacuum release valve for manually controlling the flow of fluid through the apertures in the base. Manual operation of the vacuum release valve permits air to enter the upper portion of the filler tank thereby permitting equalization of pressure which allows for the flow of fluid through the base apertures into the receptacles, thus allowing for selective manual control of fluid flow by the user.

12 Claims, 5 Drawing Figures

DISPENSER APPARATUS

BACKGROUND OF THE INVENTION

1. Technical Field

The present invention relates to a liquid dispenser apparatus in which a plurality of liquid retaining receptacles are filled simultaneously. In particular, the invention relates to a manually operated liquid dispenser for simultaneously filling a plurality of receptacles for a communion tray or the like.

2. Background

Many manually operable liquid dispensers are known in the art. Typically, a single spigot is employed to dispense liquid into each individual receptacle. Other receptacle filling devices include a pitcher or container with some form of spout to facilitate the pouring or squirting of liquid into individual cups or receptacles. The user must possess a certain amount of dexterity to quickly and efficiently fill a large number of receptacles without unwanted spillage. Unfortunately, liquid dispensers of these particular designs are completely inadequate for quickly filling large numbers of cups or receptacles, such as may be required during large social gatherings or religious services. For example, the Christian practice of communion requires the ceremonial ingestion of either wine or grape juice by the attending congregation. For reasons of sanitation many churches no longer use a single drinking cup, but instead distribute individual cups to each person. To facilitate distribution, the disposable cups are nested in trays which hold approximately thirty cups and distributed to the seated congregation. Each individual cup must be filled and positioned in the tray, representing a time consuming, tedious, and often messy procedure especially when large multitudes of people attend a service.

There has therefore been a need to provide an apparatus which efficiently will dispense liquid into a large number of cups or receptacles. Despite recognition of the foregoing, the art has generally lacked a dispenser apparatus which simultaneously fills a plurality of liquid receptacles accurately in a timely manner yet without spillage.

SUMMARY OF THE INVENTION

The invention relates to a liquid dispenser. More specifically the invention relates to an apparatus for a manually filling a plurality of liquid receptacles simultaneously.

For achieving the foregoing, the dispenser apparatus comprises a base having a plurality of apertures through which liquid may flow into receptacles or cups positioned thereunder. Leg members support the base to position the apparatus over the receptacles. A filler tank is secured to the base for retaining a volume of liquid to be dispensed. Sandwiched between the filler tank and the base, a slide cover is manually rotatable over the base between an open position and a closed position so that a plurality of selectively placed apertures in the side cover line up with selected apertures in the base to permit fluid flow therethrough. When the slide cover is manually rotated into the closed position, the slide cover apertures are not in alignment with the base apertures, thereby preventing fluid communication between the filler tank and the apertures of the base and sealing the liquid within the apparatus. When the slide cover is in an open aligned position, the vacuum created within the filler tank prevents dispensing of the liquid through the apertures into the receptacles. The filler tank of the apparatus includes a vacuum release valve for manually controlling the flow of fluid through the apertures in the base. Manual operation of the vacuum release valve permits air to enter the upper portion of the filler tank thereby permitting equalization of pressure which allows for the flow of fluid through the base apertures into the receptacles, thus allowing for selective manual control of fluid flow by the user. Successive trays containing a plurality of liquid receptacles may be efficiently positioned beneath the apparatus and filled by intermittent dispensing of liquid through the apertures of the base by manual operation of the vacuum release valve when the slide cover is in an open position. The filler tank may be filled with liquid through an opening in the upper portion of the tank. The apparatus may be disassembled for easy cleaning and storage. The filler tank is secured to the base by a bolt and wing nut assembly which, when tightened compresses the filler tank to the base and slide cover to create a fluid tight seal. The wing nut may be removed and the filler tank separated from the base, so that the slide cover may be changed or the apparatus cleaned. A drip tray may be positioned beneath the base to permit unwanted leakage from the apparatus. A variety of interchangeable slide covers may be used to vary the number and orientation of apertures in the base through which liquid will flow, depending upon the arrangement of receptacles beneath to be filled.

It is therefore an object of the invention to provide a novel and inexpensive liquid dispensing apparatus.

It is another object of the present invention to provide a liquid dispensing apparatus which simultaneously will fill a plurality of liquid receptacles.

It is yet another object of the present invention to provide a liquid dispensing apparatus under which receptacles may be positioned and selectively filled at desired levels.

It is a further object of the present invention to provide a dispenser apparatus in which a rotatable slide cover is disposed between the filler tank and the base for selectively dispensing liquid through selected ones of said apertures, wherein the slide cover may be replaced according to the arrangement of receptacles desired to be placed beneath the base.

BRIEF DESCRIPTION OF THE DRAWINGS

The novel features believed characteristic of the present invention are set forth in the appended claims. The invention itself; however, as well a preferred mode of use, further objects and advantages thereof, will best be understood by reference to the following detailed description of an illustrative embodiment when read in conjunction with the accompanying drawings, wherein:

DESCRIPTION OF THE PREFERRED EMBODIMENTS

Figure 1:
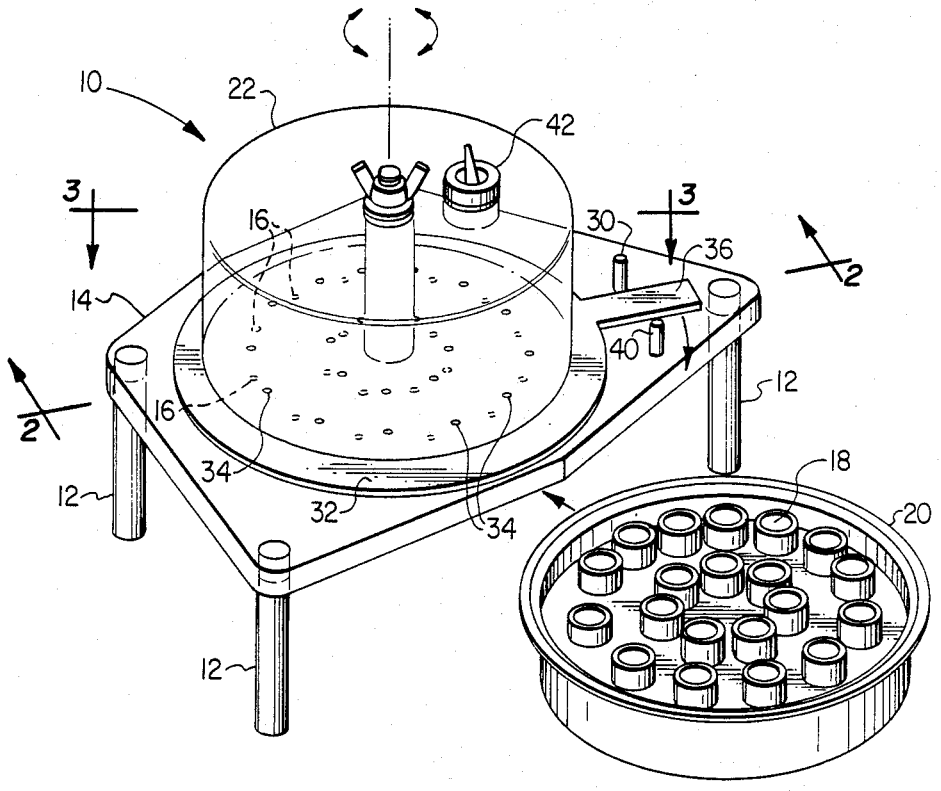
FIG. 1 is a perspective view of the dispenser apparatus.
Figure 2:
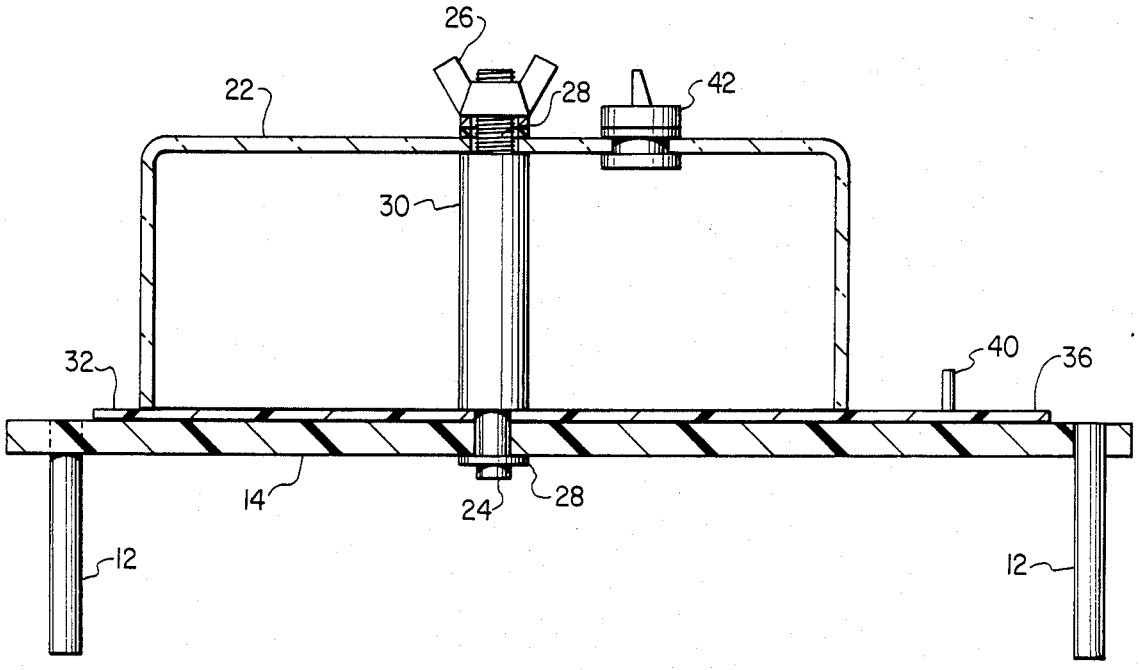
FIG. 2 is a side view of the dispenser apparatus.

With reference now to the drawings, and in particular with reference to FIG. 1, there is illustrated the dispenser apparatus 10 of the present invention. Leg members 12 elevate and support base member 14. Base member 14 includes a plurality of base aperture 16 having capillary size diameters which prevent liquid from flowing under the force of gravity into selectively positioned liquid retaining receptacles 18 until air is selectively released into the dispenser apparatus 10. As seen in the preferred embodiment, liquid receptacles 18 may be systematically arranged in a tray 20 and quickly positioned beneath base 14 directly under base aperture 16 for efficient dispensing of liquid without spillage. Filler tank 22 is secured to base 14 for retaining a volume of liquid to be dispensed. Filler tank 22 is secured to base 14 by a bolt 24 and wing nut assembly 26. Appropriate compression washers permit wing nut 26 to be tightened without causing damage to either base 14 or filler tank 22, as seen in FIG. 2. An appropriate tank sleeve 30 is positioned over bolt 24 within filler tank 22 to separate liquid from bolt 24. Wing nut 26 may be removed and filler tank 22 separated from base 14 during normal disassembly or cleaning operations.

With reference now to FIGS. 1 and 2, slide cover 32 is disposed between filler tank 22 and base 14. Slide cover 32 includes a plurality of cover apertures 34 which may be aligned with base apertures 16 to permit liquid to flow from filler tank 22 through base aperture 16 into liquid receptacles 18. Slide cover 32 is manually rotatable about bolt 24 between an open position and closed position wherein cover apertures 34 are in alignment with base aperture 16 during the open position and alternatively cover apertures 34 are displaced from base aperture 16 during the closed position. Slide cover 32 may be manually rotated between open and closed positions by cover handle 36.

Figure 3:
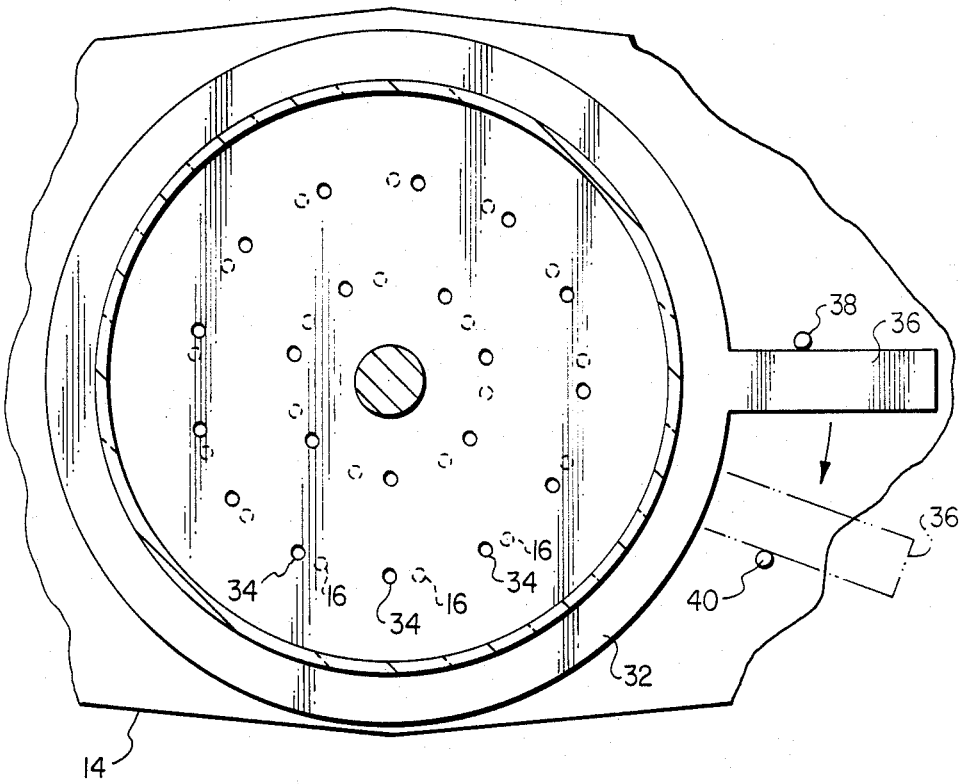
FIG. 3 is a cut-away top view of the base and slide cover of the dispenser apparatus.

With reference now to FIG. 3, there is depicted an overhead view of the slide cover 32 and base 14 assembly of dispenser 10. When cover handle 36 is manually rotated against open stop 38, cover apertures 34 are in alignment with base apertures 16 to permit fluid flow therethrough. Handle 36 may be rotated to its position against closed stop 40 such that cover apertures 34 are displaced from alignment with base aperture 16, thereby preventing fluid from exiting through base 14 into receptacles 18. When slide cover 32 is in the open position with handle 36 against open stop 38, such that cover apertures 34 are in alignment with base apertures 16, fluid will remain within filler tank 22 because of vacuum pressure. Vacuum release valve 42 is positioned along an upper portion of filler tank 22 to manually permit entry of air into filler tank 22 thereby causing fluid to flow through aperture 16 into receptacles 18. Vacuum release valve 42 is removable and also serves as a filler access for pouring liquid into filler tank 22.

Figure 4:
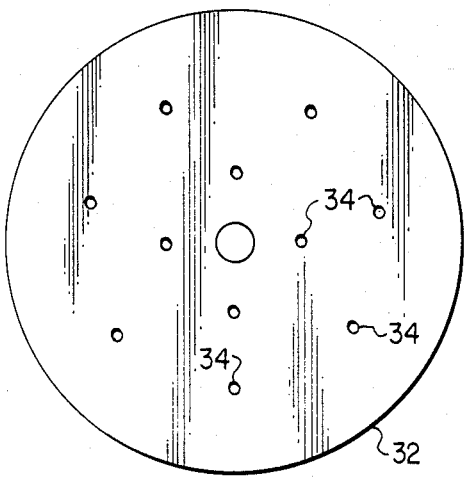
FIGS. 4 and 5 are alternative configurations for slide covers to be used in conjuction with the dispenser apparatus.
Figure 5:
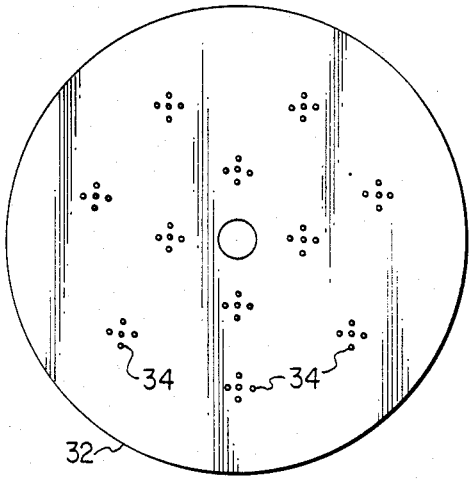

With reference now to FIGS. 4 and 5, there is depicted alternative embodiments of the slide cover 32. According to the arrangement and size of receptacles 18, cover apertures 34 may be varied in arrangement according to desired dispensing conditions. The existing arrangement of base apertures 16 may be selectively utilized according to the particular slide cover 32 which is used.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover such modifications that fall within the true scope of the invention.

What is claimed is:

1. Apparatus for simultaneously filling a plurality of liquid receptacles comprising:

a base having a plurality of base apertures oriented in said base to correspond to a pattern of receptacles placed therebeneath having capillary size diameters which prevent liquid from flowing by the force of gravity through said base apertures until air is selectively released into the filler tank;

leg members supporting said base to position said apparatus over a plurality of said receptacles;

filler tank secured to said base for retaining liquid;

a rotatable slide cover disposed between said filler tank and said base for dispensing liquid through selected ones of said base apertures, said slide cover being interchangeable to provide differing arrangements of apertures therein corresponding the desired number and arrangement of receptacles to be filled.

2. Apparatus according to claim 1 wherein:

said filler tank is secured to said base with a removable bolt and wing nut assembly.

3. Apparatus according to claim 1 wherein:

said filler tank includes a vacuum release valve for manually controlling flow of fluid through said base apertures into said plurality of liquid receptacles.

4. The apparatus according to claim 3 wherein:

said vacuum release valve may be removed to permit filling of said filler tank.

5. The apparatus according to claim 1 wherein:

said slide cover is manually rotatable over said base between an open position and a closed position and includes a plurality of selectively placed cover apertures which in said open position line up with selected base apertures to permit fluid flow therethrough, and in said closed position prevent fluid communication between said filler tank and said base apertures.

6. The apparatus according to claim 1 wherein a tray containing said liquid receptacles may be easily and consistently positioned beneath said base for liquid to be dispensed through said apertures of said base into said liquid receptacles.

7. Apparatus for simultaneously filling a plurality of liquid receptacles comprising:

a base having a plurality of base apertures oriented in said base to correspond to a pattern of receptacles placed therebeneath having capillary size diameters which prevent liquid from flowing by the force of gravity through said base apertures until air is selectively released into the filler tank;

filler tank secured to said base for retaining liquid;

interchangeable slide cover disposed between said base and said filler tank having selectively positioned cover apertures for permitting liquid to flow from said filler tank through selected base apertures, said slide cover manually rotatable between an open position where said cover apertures correspond in overlying relation to said base apertures to permit liquid to flow therethrough, and a closed position where liquid is prevented from reaching said base apertures.

8. The apparatus according to claim 7 wherein:

said filler tank includes a vacuum release valve manually operable to intermittently release air into said filler tank thereby causing selected flow of liquid through said base apertures into said receptacles at times when said slide cover is in said open position.

9. The apparatus according to claim 8 wherein:

said vacuum release valve may be removed to permit filling of said filler tank.

10. The apparatus according to claim 1 wherein:

said cover apertures are positioned to permit filling liquid receptacles resting in a communion tray beneath said base.

11. Apparatus for simultaneously filling a plurality of liquid receptacles, comprising:

a base positionable over a plurality of liquid receptacles;

filler tank removably secured to said base for retaining liquid;

base apertures oriented in said base to correspond to a selected pattern of receptacles placed therebeneath having diameters sufficiently small wherein the cohesive forces of the liquid within the filler tank prevent liquid from flowing by the force of gravity through said base apertures, until air is released into the upper portion of said filler tank;

a rotatable slide cover disposed between said base and said filler tank having selectively positioned cover apertures for permitting liquid to flow from said filler tank through said base apertures upon release of air into an upper portion of said filler tank, wherein said slide cover is manually rotatable about a central axis between an open position where said cover apertures correspond in overlying relation to base apertures to permit liquid to flow therethrough, and a closed position where liquid is prevented from reaching the base apertures.

12. The apparatus according to claim 11 wherein:

interchangeable slide covers may be disposed between said base and said filler tank according to the desired number and configurations of receptacles to be filled beneath said base.

* * * * *